United States Patent [19]

Goodnow et al.

[11] Patent Number: 4,906,335

[45] **Date of Patent: * Mar. 6, 1990**

[54] DOCTORING APPARATUS

[75] Inventors: Ronald F. Goodnow, Leicester; Robert A. Reid, Charlton City; Robert Austin, Auburn, all of Mass.

[73] Assignee: Thermo Electron Web System, Inc., Auburn, Mass.

[ * ] Notice: The portion of the term of this patent subsequent to Dec. 6, 2005 has been disclaimed.

[21] Appl. No.: 238,200

[22] Filed: Aug. 30, 1988

Related U.S. Application Data

[63] Continuation of Ser. No. 59,508, Jun. 8, 1987, Pat. No. 4,789,432.

[51] Int. Cl.[4] ..... D21G 3/00

[52] U.S. Cl. ..... 162/281; 118/261; 118/652; 15/256.51

[58] Field of Search ..... 15/256.51; 162/281; 34/120; 100/174; 118/261, 652; 101/162, 425; 430/125; 355/15

[56] References Cited

U.S. PATENT DOCUMENTS

| | | | |
|---|---|---|---|
| 3,361,059 | 1/1968 | Klinger | 118/261 |
| 3,529,315 | 9/1970 | Dunlap et al. | 15/256.51 |
| 3,748,686 | 7/1973 | Winterburn et al. | 15/256.51 |
| 3,778,861 | 12/1973 | Goodnow | 15/256.51 |
| 4,367,120 | 1/1983 | Hendrikz | 15/256.51 |
| 4,665,859 | 5/1987 | Dunlap et al. | 118/261 |
| 4,789,432 | 12/1988 | Goodnow et al. | 15/256.51 |

*Primary Examiner*—Karen M. Hastings

*Attorney, Agent, or Firm*—Samuels, Gauthier, Stevens & Kehoe

[57] ABSTRACT

An apparatus for doctoring a cylindrical rotating surface, comprising a doctor back mounted for rotation about a first axis, and a blade carrier assembly mounted on the doctor back for rotation about a second parallel axis. A doctor blade is removably supported by the blade carrier assembly and is loaded against the rotating surface by a force applied to rotate the doctor back about the first axis. A liquid filled flexible walled tube extends along the second axis between the doctor back and the blade carrier assembly. The blade angle is adjusted by expanding and contracting the liquid filled tube to rotate the blade carrier about the second axis.

6 Claims, 6 Drawing Sheets

DOCTORING APPARATUS

This is a continuation of Ser. No. 59,508 filed June 8, 1987, now U.S. Pat. No. 4,789,432.

BACKGROUND OF THE INVENTION

1. Field of the Invention

This invention relates to a doctoring apparatus of the type employed in the processing of paper, textiles and other like industrial products.

2. Description of the Prior Art

In the conventional doctoring apparatus, the working edge of a doctor blade is applied to a rotating surface from which materials are to be removed. In some cases, the doctored material may consist of a sheet or web being processed on the rotating surface, whereas in other cases the doctored material may consist of contaminants accumulating on the surface.

Among the critical factors contributing to an effective doctoring operation are optimum blade angle, and a uniform blade loading pressure along the entire length of the blade/surface contact line. If the blade angle is too large, the blade will have a tendency to dig or jam into the doctored surface and thus cause serious damage, whereas if the blade angle is too small, the material to be doctored will escape beneath the blade, causing machine damage and/or loss of production. Excessive blade loading pressure will accelerate wear of both the blade and the doctored surface, in addition to increasing the power required to overcome the accompanying increased friction. Insufficient or non-uniform blade loading pressure again may allow material to escape beneath the blade.

A number of attempts have been made at providing a doctoring apparatus capable of maintaining an optimum blade angle and uniform blade loading pressure. One such apparatus is illustrated in FIG. 1, where a doctor back 2 has a generally L-shaped configuration with end shafts 4 supported in bearings 6 for rotation about a first axis $A_1$. The bearings 6 are carried on a support structure 10 and are adjustable to accommodate shifting of axis $A_1$ in the direction indicted by arrow 12. The doctor back is rotated about axis A1 by any conventional means, for example pneumatically actuated piston-cylinder units 14.

The doctor back carries a blade holder 16. As can be better seen in FIG. 2, the blade holder includes a relatively rigid and inflexible top plate 18 and an underlying rigid and inflexible jaw 20. A doctor blade 22 is removably received and supported between the top plate 18 and jaw 20. The top plate 18 is secured to the doctor back by hold down screws 24.

During initial set up of the machine, the piston-cylinder units 14 are pressurized to rotate the doctor back in a clockwise direction as viewed in FIG. 1, thereby loading the doctor blade 22 against the surface S being doctored. The surface S may have localized low spots. Thus, adjustable set screws 26 are provided to "fit" the blade to these low spots.

With this type of doctoring apparatus, blade loading pressure is a function of the force being exerted by the piston-cylinder units 14, and the blade angle $\propto$ is a function of the position of the axis $A_1$ relative to the surface S. In order to adjust the blade angle, the bearings 6 must be shifted in the direction indicated at 12. Thus, once the machine is in operation, if it is determined that the blade angle needs further adjustment, the entire machine must be shut down to provide maintenance personnel with access to the bearings 6, thereby resulting in protracted and costly lost production time. A further drawback with this type of apparatus is that because the doctor blade 22 is held between the relatively rigid and inflexible top plate 18 and jaw 20, it lacks the flexibility to satisfactorily accommodate irregularities in the surface S being doctored, this despite the ability to perform localized adjustments by means of the set screws 26.

A modified prior art blade holder is disclosed in FIG. 3. Here, the rear edge of the doctor blade 22 is supported on a liquid-filled and completely sealed flexible reaction tube 28. Although this enhances the ability of the blade to conform to localized irregularities of the surface S being doctored, the same problems remain with respect to the difficulty of changing the blade angle $\propto$.

Another prior art doctoring apparatus is illustrated in FIG. 4A. This apparatus is similar to that shown in FIG. 1 in that it too has a doctor back 2 with end shafts 4 mounted in bearings 6 for rotation about an axis $A_1$ under the influence of piston-cylinder units 14. Here, however, the piston-cylinder units 14 do not load the doctor blade 22 against the surface S. Instead, the piston-cylinder units merely serve to locate the working edge of the doctor blade close to but spaced from surface S by pulling the doctor back against an adjustable stop 29. Although not illustrated, it will be understood that the same result could be achieved by causing the piston cylinder units to "bottom out", or by substituting turnbuckles for the piston cylinder units.

The apparatus of FIG. 4A includes a further modified blade holder of the type shown in FIGS. 4B and 4C. Here, the blade holder includes a series of pressure fingers 30 spaced along a common axis $A_2$. The doctor blade 22 is held between the fingers 30 and a flexible top plate 32, and pneumatically inflated tubes 34,36 extend along opposite sides of the axis $A_2$ between the fingers 30 and the doctor back 10.

With this type of doctoring apparatus, once the piston-cylinder units 14 have been actuated to fix the doctor back 2 at a selected position, e.g., against stop 29, final blade loading against surface S is achieved by pneumatically inflating tube 34 (with an accompanying deflation of tube 36). The level of blade loading is thus a function of the air pressure in tube 34 acting across a contact width W.

However, as illustrated in FIG. 4C, if the doctor back 2 remains fixed while the blade angle $\propto$ increases, either because of blade wear or because process requirements mandate such an increase, the tube 34 will necessarily expand to accommodate rotation of the fingers 30 about axis $A_2$. This in turn will cause the contact width W to decrease with an accompanying decrease in the level of blade loading. In other words, with this apparatus, the level of blade loading is inversely proportional to blade angle. If the level of blade loading becomes inadequate, there is a danger that the blade will lift off of the surface S, with potentially disastrous consequences.

In order to keep the contact width W within an acceptable range, the doctor back 2 must be readjusted by shifting the bearings 6 and adjusting the stop 29, thereby again necessitating protracted down time and lost production.

The prior art apparatus of FIGS. 4A–4C suffers from still other drawbacks. For example, the combination of individual pressure fingers 30 acted upon by a pneumatically inflated tube 34 results in maximum blade flexibility. However, a sudden impact at any localized zone along the blade length can cause the affected blade section to be lifted off of the surface S, again with potentially disastrous consequences.

Also, the axis $A_2$ is conventionally defined by a long rod or shaft threaded through the individual fingers from one side of the machine to the other. This is a difficult and laborous procedure which contributes significantly to machine down time when maintenance, e.g., clearing of the holder is required.

U.S. Pat. Nos 3,163,878; 3,748,686; and 3,803,665 illustrate other examples of doctoring apparatus employing pneumatically inflated tubes to load the doctor blades against the surfaces being doctored.

SUMMARY OF THE INVENTION

A general object of the present invention is to provide a novel and improved doctoring apparatus which either avoids or at least substantially minimizes the problems associated with the prior art.

A more specific object of the present invention is to provide a doctoring apparatus which enables the blade angle to be adjusted without interrupting the production process.

Still another object of the present invention is to provide a means of flexibly supporting the doctor blade along the blade length while avoiding problems resulting from sudden localized impacts.

A further object of the present invention is to provide a doctoring apparatus wherein blade wear has little if any effect on blade loading and only minimal effect on blade angle.

In a preferred embodiment of the invention to be described hereinafter in greater detail, these and other objects and advantages are achieved by providing a doctoring apparatus having a doctor back mounted for rotational movement about a first axis parallel to the rotational axis of a cylindrical surface from which material is to be doctored. A blade carrier assembly is mounted on the doctor back for rotational movement about a second axis parallel to the first axis. A doctor blade is removably received by the blade carrier assembly, and a flexible walled equalizing tube containing a supply of liquid is arranged alongside the second axis at a location interposed between the blade carrier assembly and the doctor back. A first actuating mechanism is employed to rotatably urge the doctor back in one direction about the first axis to load the doctor blade against the rotating surface, with the blade carrier assembly thus being rotatably urged in the opposite direction about the second axis and against the equalizing tube. A second actuating mechanism is employed to expand and contract the equalizing tube by varying the supply of liquid contained therein, thereby rotatably displacing the blade carrier assembly about the second axis to effect changes in blade angle.

Preferably, the equalizing tube and the second actuating mechanism comprise interconnected components of a closed hydraulic circuit. Where relatively high ambient temperature conditions exist, such as for example when doctoring heated cylinders or rolls, the closed hydraulic circuit is preferably adapted to accommodate a convective circulating liquid flow between the equalizing tube and the second actuating mechanism Where necessary, a heat exchanger may be associated with the hydraulic circuit to control the temperature of the circulating liquid flow.

The first actuating mechanism preferably comprises pneumatic cylinders acting on the doctor back to urge the doctor blade against the rotating surface with a constant blade loading pressure. When the second actuating mechanism is employed to expand or contract the equalizing tube in order to rotate the blade carrier assembly in a given direction about the second axis to effect a change in blade angle, the first actuating mechanism reacts by accommodating rotation of the doctor back in the opposite direction about the first axis, while continuing to maintaining a constant blade loading pressure.

DETAILED DESCRIPTION OF ILLUSTRATED EMBODIMENTS

Figure 5:
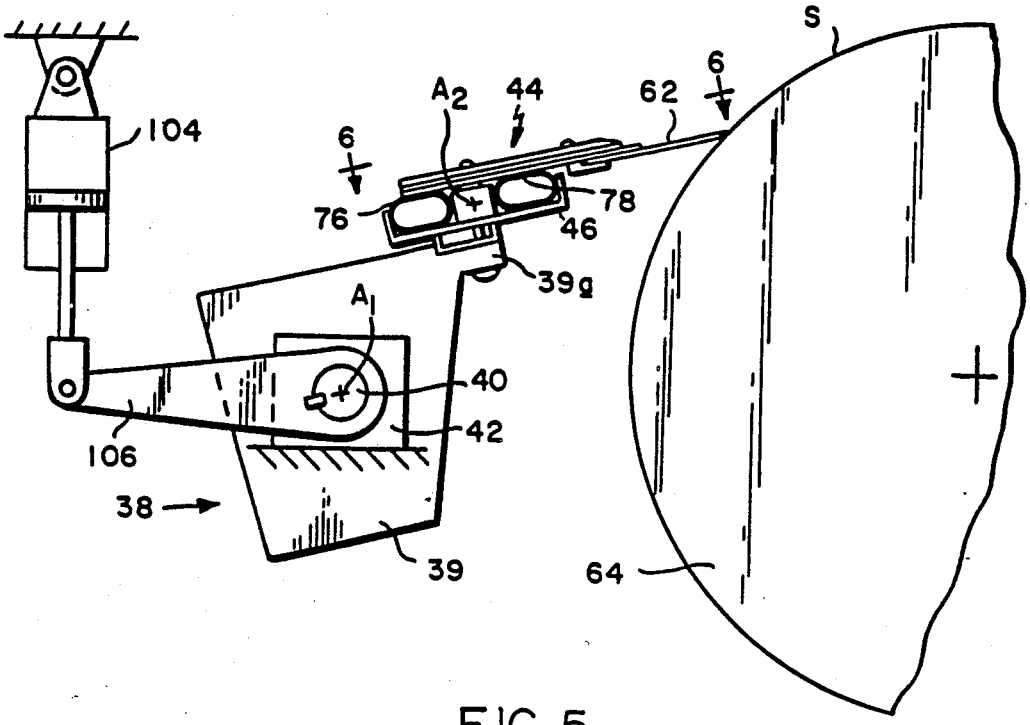
FIG. 5 is a side elevational view of a doctoring appartus in accordance with the present invention.

Referring initially to FIG. 5, a doctoring apparatus in accordance with the present invention comprises a doctor back generally indicated at 38. The doctor back is keyed or otherwise fixed to a shaft 40, the latter being supported by bearings 42 for rotation about a first axis $A_1$. A blade carrier assembly 44 is mounted on the doctor back 38.

Figure 6:
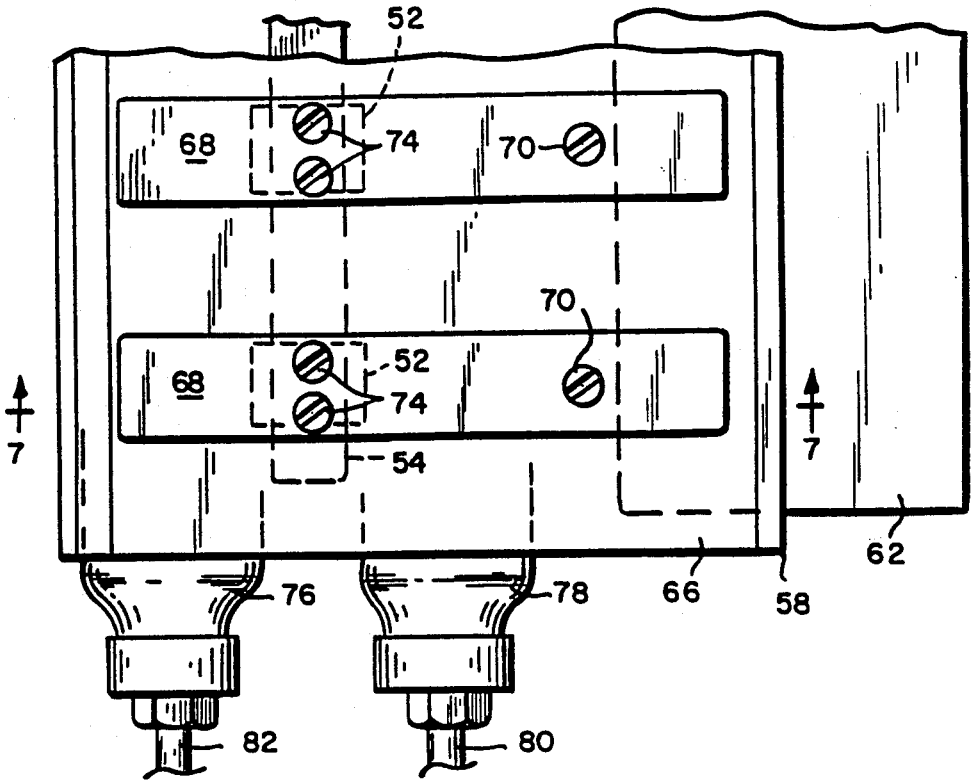
FIG. 6 is a partial plan view on an enlarged scale on line 6—6 of FIG. 5.
Figure 8:
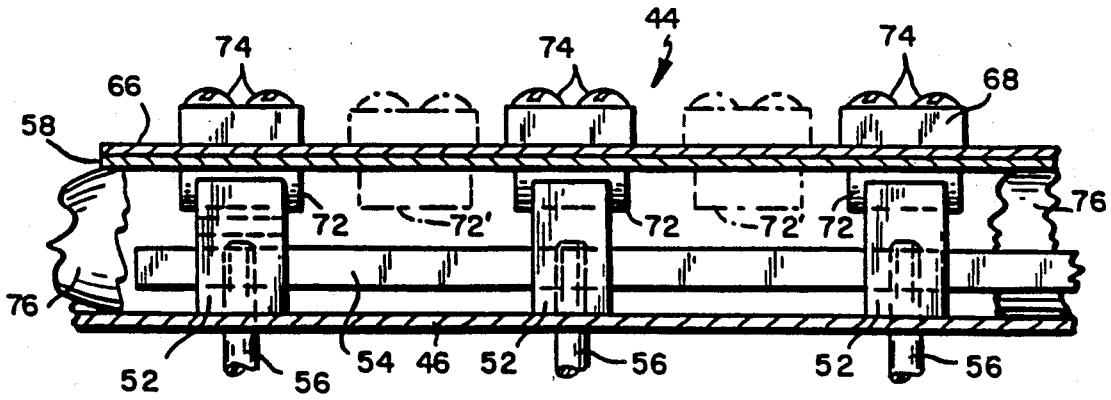
FIG. 8 is a sectional view with portions of the equalizing tube broken away taken along line 8—8 of FIG. 7.
Figure 7:
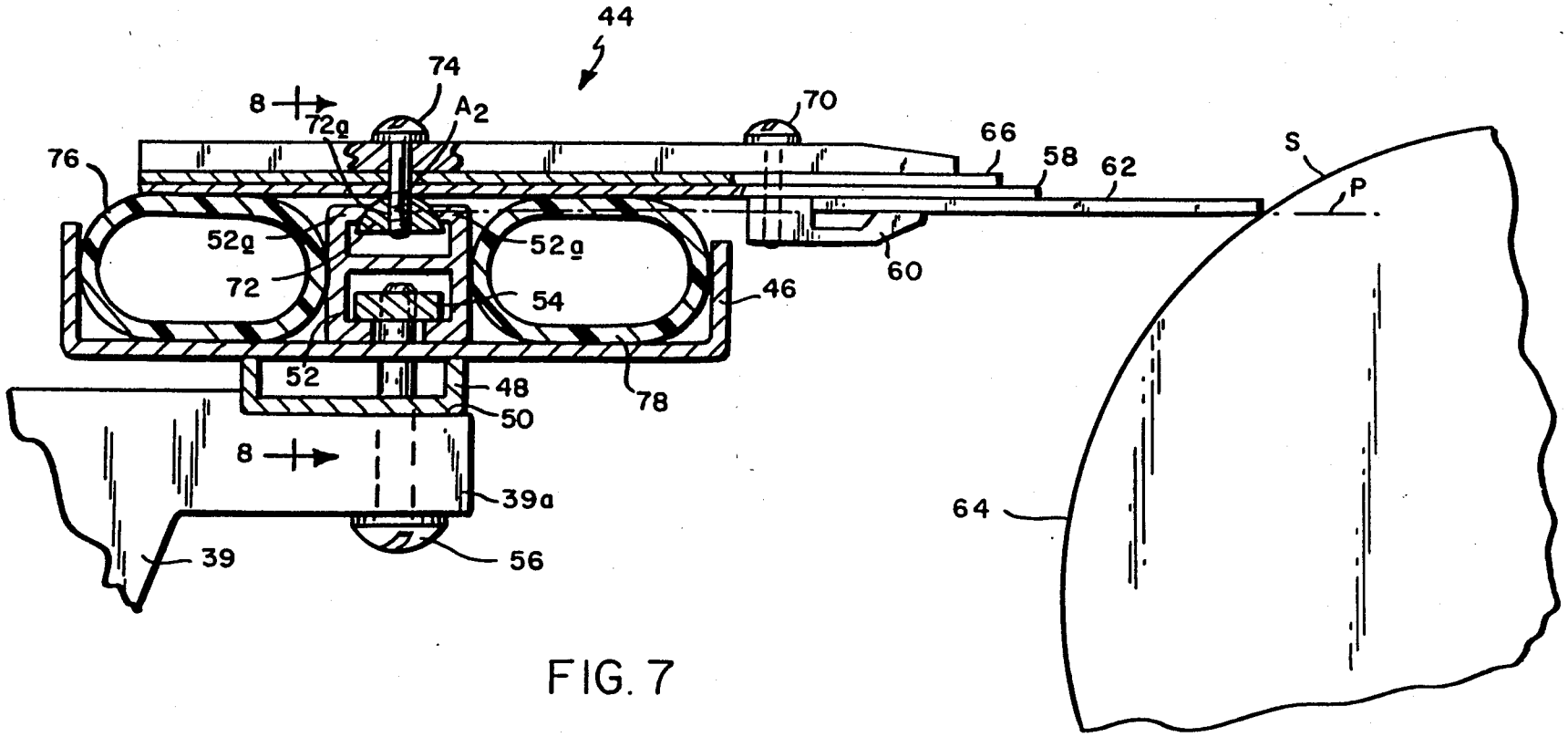
FIG. 7 is a sectional view taken along line 7—7 of FIG. 6.

As can best be seen in FIGS. 6-8, the doctor back 38 includes a beam 39 with a forwardly protruding nose **39*a*. A tube tray 46 has a channel-shaped support member 48 fixed to the underside thereof The support member 48 is located in a notch 50 extending along the forwardly protruding nose 39*a* of the beam 39. A plurality of pivot brackets 52 are spaced along the length of the tray 46 and are held in place by a keeper bar 54 and machine screws 56 which are threaded through the keeper bar and which extend upwardly through aligned unthreaded holes in the beam 39, support member 48, tray 46 and brackets 52**.

The blade carrier assembly 44 includes a flexible top plate 58 overlying the tray 46 with a jaw member 60 extending along the underside thereof. A doctor blade 62 is received between and supported by the top plate 58 and jaw member 60 for application to the cylindrical rotating surface S of a roll or cylinder 64. The blade carrier assembly further includes a loading plate 66 overlying the top plate 58. A plurality of pressure fingers 68 are spaced along the loading plate. The pressure fingers 68, loading plate 66, top plate 58 and jaw member 60 are held together by retaining screws 70.

Short pivot rods 72 are secured by means of retaining screws 74 to the underside of the top plate 58 at locations underlying each of the pressure fingers 68. The pivot rods 72 have half round cross-sections, and their semi-cylindrical surfaces 72*a* coact with the semi-cylindrical edges of confronting inwardly disposed flanges 52*a* on the brackets 52 to establish a second axis $A_2$ about which the blade carrier assembly 44 can rotate. The axes $A_1$ and $A_2$ are parallel to each other as well as being parallel to the rotational axis of the roll 64.

A pair of flexible-walled tubes 76,78 extend along opposite sides of the second axis $A_2$, each tube being interposed between the blade carrier assembly 44 and the tube tray 46 of the doctor back 38.

Figure 9:
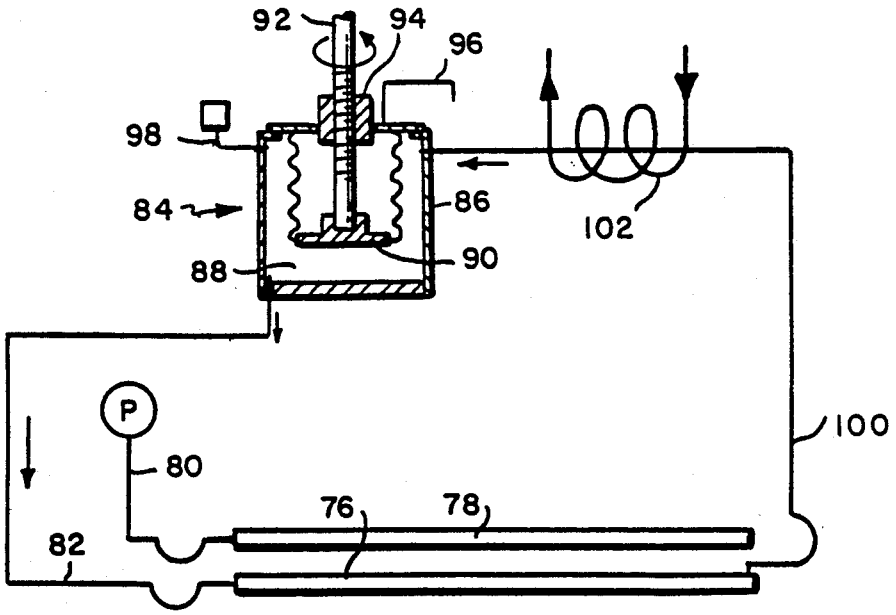
FIGS. 9 and 10 are schematic illustrations of various control systems which may be employed in connection with the present invention.

As can be best seen in FIG. 9, the tube 78 is pneumatically inflated via a pressure line 80 leading to a conventional source P of compressed air. Tube 76 contains a supply of liquid. The tube 76 is expanded and contracted by varying the supply of liquid contained therein. In the embodiment shown in FIG. 9, this is accomplished by connecting the tube 76 via feed line 82 to a second actuating means 84 comprising a housing 86 defining a chamber 88. A metal bellows 90 is expanded and contracted within the chamber 88 by means of a rotatable shaft 92 threaded through a fixed nut 94. Expansion of the bellows drives liquid out of the chamber 88 and into the tube 76 to expand the same, whereas contraction of the bellows has the opposite effect The interior of the bellows 90 is vented to atmosphere as at 96, and a feed connection 98 is provided to add make-up liquid to the chamber when required.

In order to avoid overheating of the liquid contained in the tube 76, it may be appropriate to accommodate convective liquid flow by means of a return line 100 leading from the opposite end of the tube 78 back to the chamber 88. A heat exchanger, such as for example a coil 102 through which a heat exchange medium is circulated by conventional means (not shown), may be employed to either heat or cool the liquid circulating through the return line 100. It will thus be seen that the tube 76 and second actuating means 84 comprise interconnected components of a closed hydraulic circuit.

Referring again to FIG. 5, the doctor back 38 is rotated about axis $A_1$ by means of one or more pneumatic cylinders 104 mechanically coupled to the support shaft 40 by links 106. During a doctoring operation, the cylinders 104 urge the doctor back 38 in a clockwise direction as viewed in FIG. 5 to thereby press the working edge of the doctor blade 62 against the rotating surface S with a desired blade loading pressure. As a result, the blade carrier assembly 44 is rotatably urged in the opposite direction about axis $A_2$ and against the equalizing tube 76. The liquid volume in tube 76 governs its height when it is acted upon by the blade carrier assembly 44. This in turn establishes the blade angle. The companion tube 78 is pneumatically inflated to establish a continuous seal between the underside of the top plate 58 and the tube tray 46, thereby providing an effective means of preventing penetration of contaminants between the blade carrier assembly and the doctor back. When decreasing the blade angle, the pressure in the tube 78 also serves as a means of forcing liquid being bled out of tube 76 and back to the chamber 88.

During the doctoring operation, blade loading will remain a function of the force being exerted by the cylinders 104 constituting the first actuating means, with the tube 76 serving as a force transmitting as opposed to a force exerting member. In comparison to the prior art pneumatically inflated tube 34 shown in FIGS. 4A and 4B, the liquid filled tube of the present invention has far superior load distribution characteristics when operating under dynamic conditions. More particularly, when a blade holding device incorporates a gas-filled tube, a sudden impact at a localized zone along the blade length can result in compression of the gas within the tube, which in turn can permit the process web or sheet to pass beneath the blade. This is because the gas filled tube is a "low inertia" device with only limited resistance to sudden localized impact. In contrast, the liquid filled tube of the present invention provides significantly more resistance to localized impact. The incompressible liquid media in effect creates a "high-inertia" system which encourages the entire support structure to react as a single body. Thus, an impact at one point along the blade length results in a transfer of force over the entire length of the support structure.

Because the liquid filled tube 76 and second actuating means 84 comprise interconnected components of a closed hydraulic circuit, any flow of liquid into or out of the chamber 88 will be accompanied by a change in the cross sectional configuration of the tube 76, i e., expansion or contraction, which in turn will produce a corresponding change in blade angle. More particularly, and as viewed in FIG. 5, hydraulic pressure applied to expand the tube 76 will cause the blade holder to rotate in a clockwise direction about axis $A_2$. This hydraulic pressure will override the torque acting on the doctor back 38 as a result of the forces being exerted by the pneumatic cylinders 104, with the result that the doctor back will be caused to rotate in a counter-clockwise direction about axis $A_1$, the net result being an increase in blade angle. If liquid is bled from the tube 76, the blade holder 44 and the doctor back 38 will rotate respectively in counterclockwise and clockwise directions to decrease the blade angle.

Figure 10:
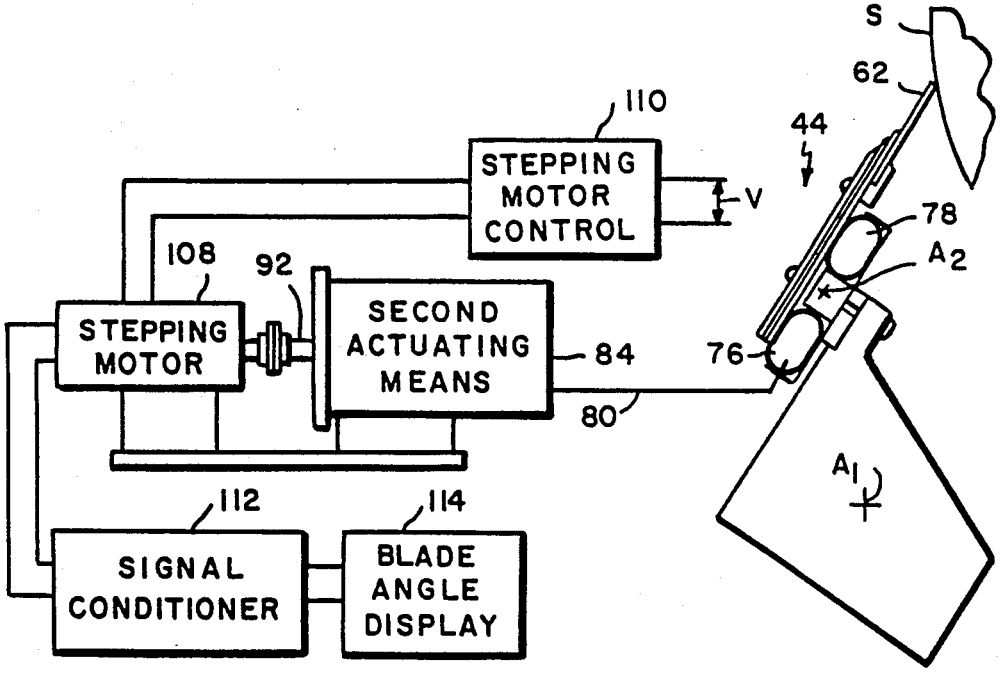

This arrangement lends itself to precise control of blade angles, from locations remote from the machine, and while the doctoring operation is in progress Thus, as depicted diagrammatically in FIG. 10, a stepping motor 108 may be employed to rotatably drive the threaded shaft 92 of the second actuating means 84. Any change in blade angle is proportional to the number of turns of the threaded shaft 92 The motor 108 may be operated from any remote location by means of a conventional control 110. By counting the number of electrical pulses or steps that the stepping motor 108 passes through, the number of shaft turns can be accurately monitored, and this step count can be processed through a signal conditioner 112 to obtain a direct blade angle readout on an appropriate display 114.

The control system of FIG. 10 may be further refined by employing position transducers to monitor the actual positions of the doctor back 38 and blade holder 44.

Other and varied control systems are possible. Most important, however, is the fact the because the equalizing tube 76 and second actuating means 84 comprise interconnected components of a closed hydraulic circuit, changes in blade angle will be directly proportional to liquid flow from one to the other of these two components, with the pneumatic cylinders 104 acting continuously to maintain a constant blade loading pressure.

The blade carrier assembly 44 of the present invention offers still other advantages over the known prior art arrangements. For example, it will be seen from FIG. 4C that axis $A_2$ is offset by a distance "x" from the plane "P" at which forces are transmited through the doctor blade 22 to its seating point in the blade holder. In contrast, as shown in FIG. 7, the axis $A_2$ of the blade holder of the present invention lies substantially on the plane P, thus contributing significantly to the stability of the blade holder.

Figure 1:
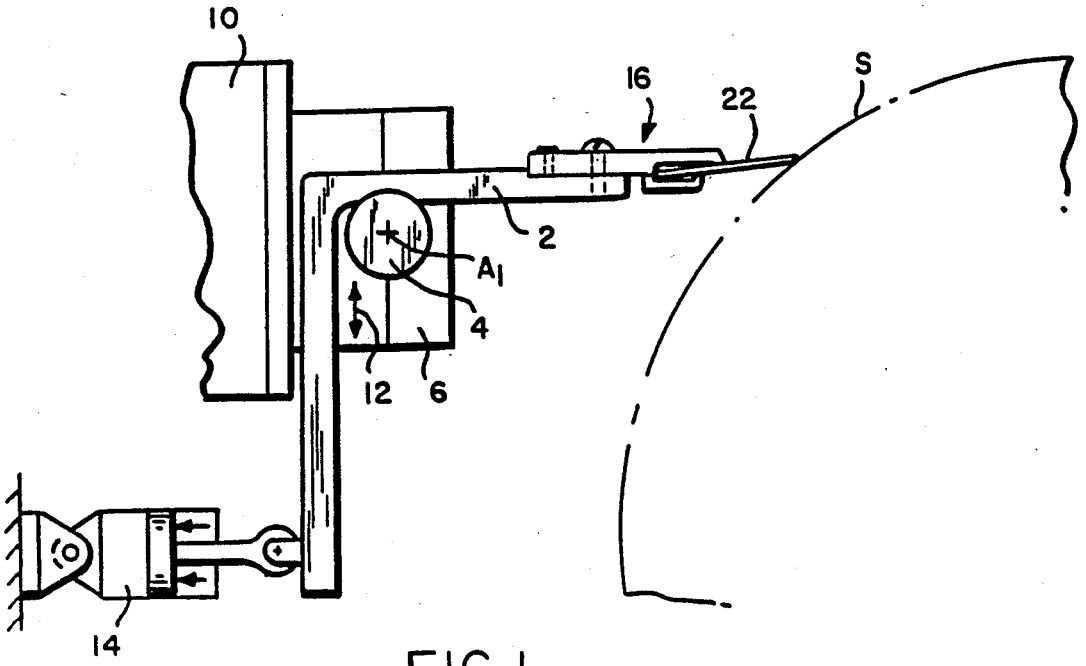
FIG. 1 PRIOR ART
FIG. 1 is a side elevational view of a prior art doctoring apparatus.
Figure 2:
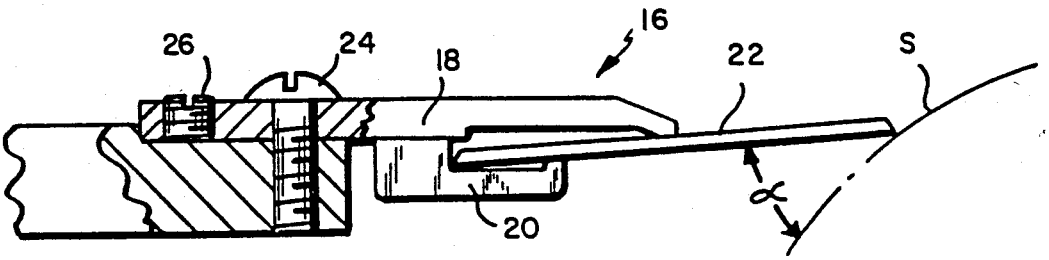
FIG. 2 PRIOR ART
FIGS. 2 and 3 are enlarged partially sectioned views showing various embodiments of prior art blade holders useful with the doctoring apparatus shown in FIG. 1.
Figure 3:
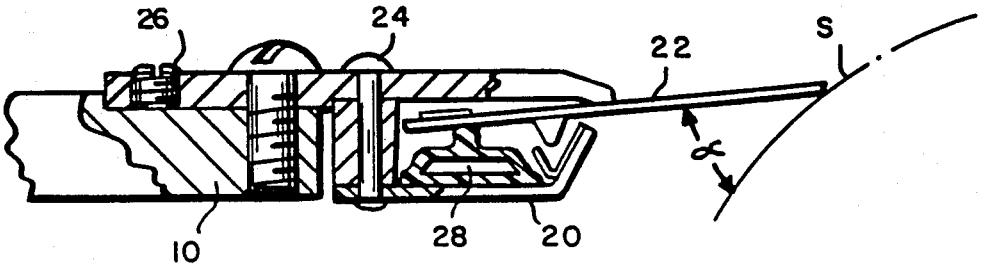
FIG. 3 PRIOR ART
Figure 4A:
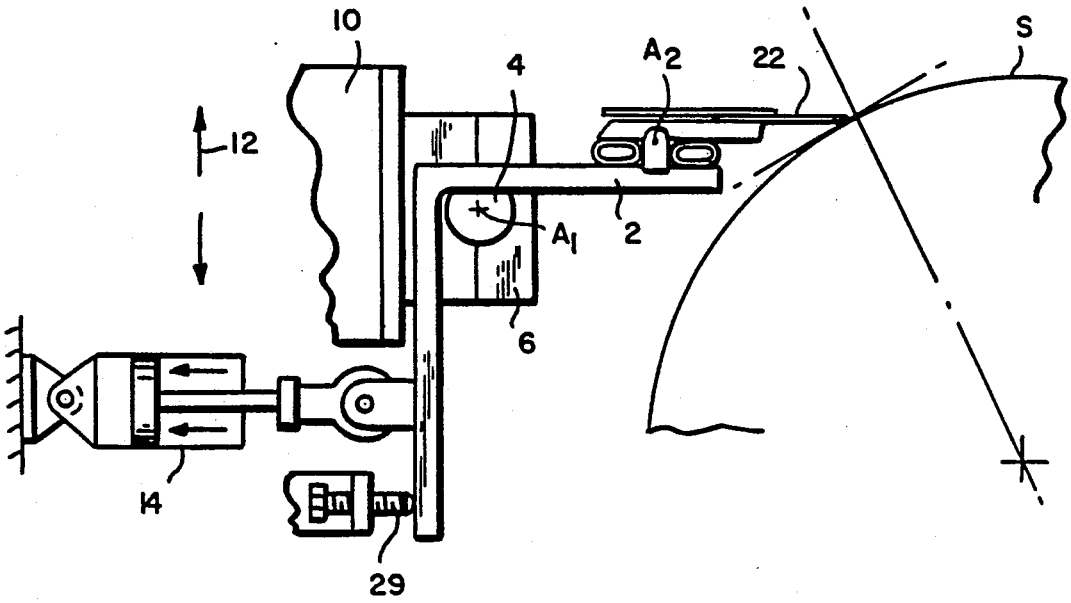
FIG. 4A PRIOR ART
FIG. 4A is a side elevational view of another prior art doctoring apparatus.
Figure 4B:
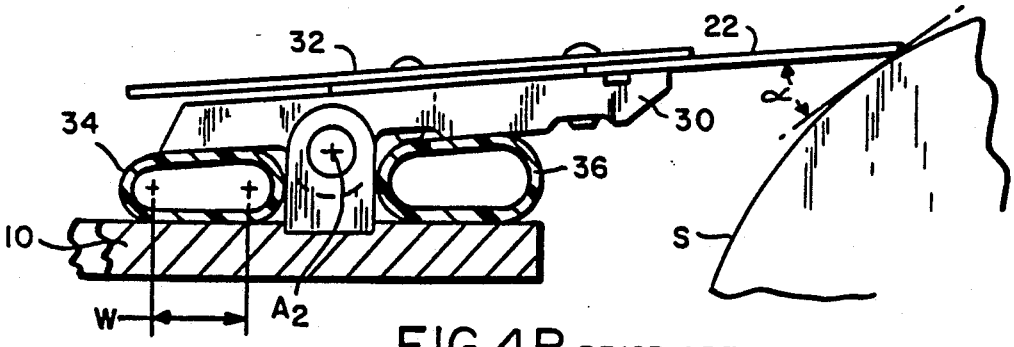
FIG.4B PRIOR ART
FIGS. 4B and 4C are enlarged partially sectional views showing the blade holder of the apparatus of FIG. 4A at different blade angles.
Figure 4C:
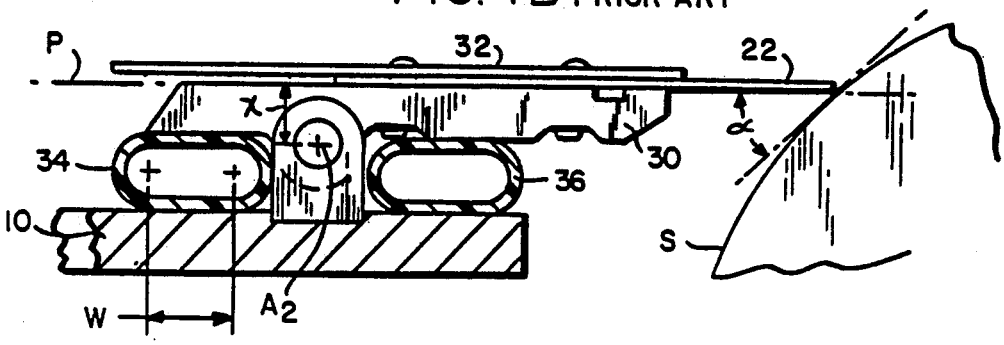
FIG.4C PRIOR ART

It will also be appreciated by those skilled in the art that in the prior art blade holders of the type shown in FIGS. 4A–4C, the axis $A_2$ is defined by a single elongated rod which must be threaded across the entire machine through each of the individual fingers 30. This is an extremely time consuming and difficult operation, which greatly prolongs the time required to change blade holders. In contrast, as can be best seen in FIGS. 6 and 8, the individual pivot rods 72 of the present invention are substantially shorter in length than the distances between the pivot brackets 52. Thus, once the tubes 76,78 are collapsed, the holder 44 can be shifted laterally a short distance to shift the pivot rods 72 to the positions indicated in dotted at 72'. This frees the entire blade holder for removal from the doctor back. Reinstallation is accomplished just as quickly by following a reverse procedure.

We claim:

1. Apparatus for doctoring a cylindrical rotating surface, said apparatus comprising:

a doctor back;

means for mounting said doctor back for rotational movement about a first axis parallel to the rotational axis of said surface;

a blade carrier assembly;

means for mounting said blade carrier assembly on said doctor back for rotational movement about a second axis parallel to said first axis;

a doctor blade removably supported on said blade carrier assembly, said doctor blade having a working edge adapted to be applied to said surface;

flexible-walled first and second tubes extending along opposite sides of said second axis at locations interposed between and in contact with said blade carrier assembly and said doctor back;

a supply of liquid contained in said first tube;

actuating means for loading the working edge of said doctor blade against said surface by rotatably urging said doctor back in one direction about said first axis, with rotation of said blade carrier assembly in the opposite direction about said second axis being hydraulically opposed by the liquid contained in said first tube; and means for pneumatically pressurizing said second tube to rotatably urge said blade carrier assembly in the said opposite direction about said second axis and against said first tube.

2. The apparatus of claim 1 wherein said carrier assembly includes a plurality of fingers overlying said tube and spaced one from the other along said second axis, and plate means interposed between said fingers and said tube.

3. The apparatus of claim 1 wherein the distance between the working edge of said blade and said first axis is greater than the distance between saids working edge and said second axis.

4. The apparatus of claim 1 wherein said second axis lies substantially on the plane at which foces are transmitted through said doctor blade to said blade carrier assembly.

5. Apparatus for doctoring a cylindrical rotating surface, said apparatus comprising:

a doctor back;

means for mounting said doctor back for rotational movement about a first axis parallel to the rotational axis of said surface;

a blade carrier assembly;

means for mounting said blade carrier assembly on said doctor back for rotational movement about a second axis parallel to said first axis, said means for mounting comprising a plurality of bracket members fixed relative to said doctor back at spaced locations along said second axis, and a plurality of pivot rods affixed to said blade carrier assembly, said pivot rods being removably received by and being supported on said bracket members for rotational movement about said second axis;

a doctor blade removably supported on said blade carrier assembly, said doctor blade having a working edge adapted to be applied to said surface;

a flexible-walled tube extending along one side of said second axis at a location interposed between and in contact with said blade carrier assembly and said doctor back;

a supply of liquid contained in said tube; and actuating means for loading the working edge of said doctor blade against said surface by rotatably urging said doctor back in one direction about said first axis, with said blade carrier assembly thus being rotatably urged in the opposite direction about said second axis and against said tube.

6. The apparatus of claim 5 wherein the length of said pivot rods is less than the distance between said bracket members, whereupon said blade carrier assembly may be freed from said doctor back by shifting said pivot rods to locations between said bracket members.

* * * * *